US009663901B2

(12) United States Patent
Heiskanen et al.

(10) Patent No.: US 9,663,901 B2
(45) Date of Patent: May 30, 2017

(54) HYDROPHOBICALLY SIZED FIBROUS WEB AND A METHOD FOR THE PREPARATION OF A SIZED WEB LAYER

(71) Applicant: STORA ENSO OYJ, Helsinki (FI)

(72) Inventors: Isto Heiskanen, Imatra (FI); Karita Kinnunen, VTT (FI); Tuomo Hjelt, VTT (FI)

(73) Assignee: STORA ENSO OYJ, Helsinki (FI)

( * ) Notice: Subject to any disclaimer, the term of this patent is extended or adjusted under 35 U.S.C. 154(b) by 187 days.

(21) Appl. No.: 14/396,634

(22) PCT Filed: Apr. 25, 2013

(86) PCT No.: PCT/FI2013/050471
§ 371 (c)(1),
(2) Date: Oct. 23, 2014

(87) PCT Pub. No.: WO2013/160564
PCT Pub. Date: Oct. 31, 2013

(65) Prior Publication Data

US 2015/0096700 A1 Apr. 9, 2015

(30) Foreign Application Priority Data

Apr. 26, 2012 (FI) ..... 20125463

(51) Int. Cl.

| | |
|---|---|
| ***D21H 27/30*** | (2006.01) |
| ***D21H 21/16*** | (2006.01) |
| ***D21H 11/02*** | (2006.01) |
| ***D21H 17/22*** | (2006.01) |
| ***D21H 11/18*** | (2006.01) |
| ***D21H 21/24*** | (2006.01) |
| ***D21H 21/56*** | (2006.01) |
| ***D21H 17/17*** | (2006.01) |
| *D21F 11/00* | (2006.01) |

(52) U.S. Cl.
CPC ..... *D21H 27/30* (2013.01); *D21H 11/02* (2013.01); *D21H 11/18* (2013.01); *D21H 17/17* (2013.01); *D21H 17/22* (2013.01); *D21H 21/16* (2013.01); *D21H 21/24* (2013.01); *D21H 21/56* (2013.01); *D21F 11/002* (2013.01)

(58) Field of Classification Search
USPC ..... 162/123, 125, 141, 158, 174, 202; 549/327–329
See application file for complete search history.

(56) References Cited

U.S. PATENT DOCUMENTS

| | | | |
|---|---|---|---|
| 3,489,827 A | 1/1970 | Mueller et al. | |
| 3,839,142 A | 10/1974 | Clarke et al. | |
| 4,184,914 A | 1/1980 | Jenkins | |
| 4,597,831 A | 7/1986 | Anderson | |
| 4,952,278 A | 8/1990 | Gregory et al. | |
| 6,103,060 A | 8/2000 | Munerelle et al. | |
| 6,562,193 B1 | 5/2003 | Elonen et al. | |
| 6,602,994 B1 | 8/2003 | Cash et al. | |
| 7,166,190 B2 | 1/2007 | Graef et al. | |
| 2005/0250861 A1 | 11/2005 | Andersson | |
| 2010/0024998 A1 * | 2/2010 | Wildlock | D21H 11/18 162/124 |
| 2011/0088860 A1 | 4/2011 | Heijnesson-Hulten et al. | |

FOREIGN PATENT DOCUMENTS

| | | |
|---|---|---|
| EP | 1783201 A1 | 5/2007 |
| FI | 980072 A | 7/1999 |
| GB | 1 395 757 | 5/1975 |
| GB | 1397378 A | 6/1975 |
| GB | 1 551 710 | 8/1979 |
| JP | 2005-223806 A | 8/2005 |
| RU | 2 177 521 C2 | 12/2001 |
| WO | WO 98/33982 | 8/1998 |
| WO | WO 01/42564 A1 | 6/2001 |
| WO | WO 02/090653 A2 | 11/2002 |
| WO | WO2004/113613 A1 | 12/2004 |
| WO | WO2009/038735 A1 | 3/2009 |
| WO | WO2010/015726 A1 | 2/2010 |
| WO | WO2012/007363 A1 | 1/2012 |

OTHER PUBLICATIONS

Application and File History for U.S. Appl. No. 14/396,554, filed Oct. 23, 2014, Inventors Karita Kinnunen et al.
PCT International Search Report and PCT Written Opinion of the International Searching Authority for PCT/FI2013/050460, Mailed Aug. 22, 2013, 10 Pgs.
Office Action and Search Report issued in Finnish Application No. 20125462, Dated Feb. 26, 2013, 1 Pg.
Radvan, B., Gatward, A. P. J., "The formation of wet-laid webs by a foaming process", Tappi, vol. 55 (1972) p. 748.
Wiggins Teape Research and Development Ltd., "New process uses foam in papermaking instead of avoiding it", Paper Trade Journal, "Now in Our Hundreth Year", Nov. 29, 1971, pp. 44-45.
Smith, M. K., Punton, V. W., Rixson, A. G., "The structure and properties of paper formed by a foaming process", TAPPI, Jan. 1974, vol. 57, No. 1, pp. 107-111.

(Continued)

*Primary Examiner* — Dennis Cordray
(74) *Attorney, Agent, or Firm* — Patterson Thuente Pedersen, P.A.

(57) ABSTRACT

A hydrophobically sized fibrous web layer, preparation of a fibrous web or a fiber-based coating, a multilayer board product having at least a middle layer formed of said fibrous web, as well as use of a heat-sensitive surfactant for said methods and products, whereby microfibrillated cellulose (MFC) and hydrophobic size are brought to a foam with water and the heat-sensitive surfactant, the foam is supplied to a forming fabric of a paper or board machine, dewatered by suction of air through the forming fabric, and dried to a web product. Alternatively the foam may be supplied onto a premade fibrous web and dried to form a coating layer. The hydrophilic functionality of the surfactant contained in the web may be destroyed by heating. Pulp of a greater fiber length, such as CTMP, may be included, to provide improved wet and dry tensile strength for the paper and board products.

20 Claims, No Drawings

(56) References Cited

OTHER PUBLICATIONS

PCT International Search Report and PCT Written Opinion of the International Searching Authority for PCT/FI2013/050471, mailed Aug. 22, 2013, 13 pgs.
Office Action and Search Report issued in Finnish Application No. 20125463, dated Mar. 22, 2013, 4 pgs.
Russian Search Report and English translation for Russian Patent Application No. 2014146501, dated Mar. 1, 2017, 8 pages.

* cited by examiner

HYDROPHOBICALLY SIZED FIBROUS WEB AND A METHOD FOR THE PREPARATION OF A SIZED WEB LAYER

RELATED APPLICATIONS

This application is a National Phase entry of PCT Application No. PCT/FI2013/050471, filed Apr. 25, 2013, which claims priority from Finland Application No. 20125463, filed Apr. 26, 2012, the disclosures of which are hereby incorporated by referenced herein in their entirety.

The present invention relates to a method for the preparation of a hydrophobically sized layer of a fibrous web, a hydrophobically sized fibrous web obtainable by said method, and a multilayer board comprising such web as at least one of the layers. As a particular aspect, foaming technique is used in the invention for producing the fibrous web.

BACKGROUND OF THE INVENTION

In the paper industry foam technique, where foam is used as a carrier phase of materials, has been used in both web formation and web coating processes. The technique is described e.g. in the publications Radvan, B., Gatward, A. P. J., The formation of wet-laid webs by a foaming process, Tappi, vol 55 (1972) p. 748; a report by Wiggins Teape Research and Development Ltd., New process uses foam in papermaking instead of avoiding it, Paper Trade Journal, Nov. 29. 1971; and Smith, M. K., Punton, V. W., Rixson, A. G., The structure and properties of paper formed by a foaming process, TAPPI, Jan 1974, Vol. 57, No 1, pp. 107-111.

In GB 1 395 757 there is described an apparatus for producing a foamed fiber dispersion for use in the manufacture of paper. A surface active agent is added to fibrous pulp with a fibre length in excess of about 3 mm, to provide a dispersion with an air content of at least 65%, to be discharged onto the forming fabric of a papermaking machine. The aim is to achieve uniform formation of the fibrous web on the fabric.

By the middle of the 1970s the foam forming process had been successfully demonstrated on a production machine. In the Wiggins Teape Radfoam process (Arjo Wiggins) fibres were delivered to the wire of a conventional Fourdrinier paper machine in suspension in aqueous foam. The development team obtained a non-layered 3D structure in papers made on a Fourdrinier machine at very high concentrations of fibres (3-5%) in water using foam.

When comparing foam and water forming methods one trend is clear. With foam forming the bulk is bigger, but the tensile index is smaller. With a bulkier structure the structure is more porous, which leads to smaller tensile index values. An interesting result from a comparison of water and foam laid samples was that tensile stiffness indexes in both cases were very close even though foam formed samples were much bulkier. The reason for that is currently unknown and requires further research.

Surfactants used in the foaming process have a negative influence on both the dry and wet tensile strength of a paper web.

The tensile strength loss may be explained by a decrease in the dry tensile strength of a paper sheet as surfactants are adsorbed on fibre surfaces hindering hydrogen bonding between the fibres. The initial wet strength is reduced by surfactants, especially for a dry content of 8-25%, due to a reduction in surface tension which results from the weakening of the main force holding the wet sheet together.

According to current understanding the main problems, which have prevented foam forming from becoming a standard web forming technology in paper, paperboard and cardboard production, are:

- too high porosity in some applications,
- reduced strength properties compared to normal low consistency wet forming,
- inferior Scott bond.
- inferior tensile strength, and
- inferior elastic modulus.

A particular problem relating to preparation of hydrophobically sized fibrous webs by foaming techniques is that with time surfactants tend to spoil the sizing. For its function in an aqueous medium the surfactant must have a hydrophobic aspect and a hydrophilic aspect, usually hydrophobic and hydrophilic moieties as opposite end groups, respectively. However, in the dried web the known surfactants, e.g. those mentioned in GB 1 395 757, gradually lose their hydrophobic functionality and turn entirely hydrophilic, thus detracting from the hydrophobic sizing. Thus far foaming has not been applied to the manufacture of hydrophobically sized papers or boards.

With foam forming a higher bulk (lower density) can be obtained as compared to normal wet forming. For typical printing and packaging paper and board grades the main drawbacks are the loss of elastic modulus ("softness") and internal strength (Scott bond or z-strength). However, the same characteristics are advantages in tissue making. Thus foam forming has been much more common in tissue paper products.

A more recent approach of improved papermaking, aiming at improving dewatering and retention of papermaking chemicals in a fibrous web formed on a forming fabric, is incorporation of microfibrillated cellulose (MFC) in the pulp suspension. U.S. Pat. No. 6,602,994 B1 teaches use of derivatized MFC with electrostatic or steric functionality for the goals, which even include better formation of the web. According to the reference the microfibrils have a diameter in the range of 5 to 100 nm.

However, the drawbacks experienced with MFC are densification and high drying shrinkage of the paper, as well as a tendency of MFC to absorb and retain a substantial amount of water, which increases the energy required for drying and reduces paper machine speed and productivity. For these reasons MFC has not won extensive use in paper industry so far.

SUMMARY OF THE INVENTION

The object of the present invention is to overcome or substantially reduce the above problems regarding printing and packaging papers and boards, by way of finding a method of making a hydrophobically sized fibrous layer by foam forming, in which the hydrophobic sizing will stand with time. The solution according to the invention is production of a web layer through the steps of (i) bringing water, microfibrillated cellulose (MFC), hydrophobic size, and a heat-sensitive surfactant into a foam, (ii) supplying the foam onto a forming fabric, (iii) dewatering the foam on the forming fabric by suction to form a web, (iv) subjecting the web to drying, and (v) heating the web to suppress the hydrophilic functionality of the surfactant.

In certain aspects of the present invention, the hydrophobic size is alkyl ketene dimer (AKD) or a derivate thereof.

In certain aspects of the present invention, the surfactant is decomposed by heat, removing the hydrophilic moiety from a hydrophobic residue. In certain aspects, the surfactant is formed from an AKD precursor by activation with a base, an alcohol or water. In certain aspects, the surfactant is turned insoluble by heat. In certain aspects, the surfactant is linear ethoxylated $C_{11}$-alcohol.

In certain aspects of the present invention, protein, such as casein, is incorporated in the foam for stabilizing the same.

In certain aspects of the present invention, starch is incorporated in the foam for additional sizing of the web.

In certain aspects of the present invention, a pulp of a greater fibre length is incorporated in the foam. In certain aspects, the pulp of a greater fibre length is mechanical pulp, such as chemithermomechanical pulp (CTMP).

In certain aspects of the present invention, the fibrous components incorporated in the foam consist of about 40 wt-% of MFC and about 60 to 95 wt-% of pulp with longer fibres.

In certain aspects of the present invention, a continuous fibrous web is formed on a running forming fabric of a paper or board machine, dewatered by suction through the web and the forming fabric, and finally dried in a drying section of the paper or board machine.

In certain aspects of the present invention, a method for providing a hydrophobically sized coating layer on a fibrous web, comprising the steps of (i) bringing water, microfibrillated cellulose (MFC), hydrophobic size, and a heat-sensitive surfactant into a foam, (ii) supplying the foam as a coat onto said fibrous web, (iii) subjecting the coat to drying, and (iv) heating the coat to suppress the hydrophilic functionality of the surfactant.

In certain aspects of the present invention, the hydrophobically sized fibrous web obtainable by the method of according to certain aspects of the present invention comprises a mixture of microfibrillated cellulose (MFC) and a pulp of a greater fibre length, together with a hydrophobic size, the web having a bulk of at least 2.5 $cm^3/g$. In some aspects, the web has a bulk of 3 to 7 $cm^3/g$. In some aspects, the web has a Scott bond value of 120 to 200 $J/m^2$. In some aspects, the web comprises starch as a further sizing component. In some aspects, the pulp of a greater fibre length is mechanical pulp, such as CTMP. In some aspects, the fibrous components of the web consist of about 5 to 40 wt-% of MFC and about 60 to 95 wt-% of pulp with longer fibres.

In certain aspects of the present invention, a multilayer board is formed, characterized in that at least one of the layers is a fibrous web according to certain aspects of the present invention. In certain aspects, the board is liquid board comprising a fibrous web as a middle layer, and on both sides of said middle layer outer layers of a bulk lower than in the middle layer.

According to certain aspects, the present invention is directed to use of a heat-sensitive surfactant for forming a hydrophobically sized layer of a fibrous web, by bringing water, cellulosic fibres, hydrophobic size and said heat-sensitive surfactant into a foam, supplying the foam as a layer onto a substrate, subjecting the layer to drying, and heating the layer to suppress the hydrophilic functionality of the surfactant. In certain aspects, the cellulosic fibres comprise microfibrillated cellulose (MFC). In certain aspects, the foam is supplied as a coating layer to a fibrous web, which forms the substrate. In certain aspects, the cellulosic fibres comprise MFC mixed with pulp of a greater fibre length, and the foam is supplied as a layer onto a forming fabric serving as the substrate, to be dewatered by suction and formed to a fibrous web.

DETAILED DESCRIPTION OF THE INVENTION

The present invention is directed at overcoming or substantially reducing problems regarding printing and packaging papers and boards, by way of finding a method of making a hydrophobically sized fibrous layer by foam forming, in which the hydrophobic sizing will stand with time. According to certain aspects of the present invention, production of a web layer comprises the steps of (i) bringing water, microfibrillated cellulose (MFC), hydrophobic size, and a heat-sensitive surfactant into a foam, (ii) supplying the foam onto a forming fabric, (iii) dewatering the foam on the forming fabric by suction to form a web, (iv) subjecting the web to drying, and (v) heating the web to suppress the hydrophilic functionality of the surfactant.

According to a preferred embodiment of the invention the surfactant is decomposed by heat, removing the hydrophilic moiety from a hydrophobic residue. For instance, US 2005/0250861 A1, the disclosure of which is incorporated by reference, describes cleavable thermolabile surfactants, which have a hydrophilic moiety comprising a β-keto acid group decomposed by heat into $CO_2$, $HCO_3^-$ or $CO_3^{-2}$, depending on pH, while a hydrophobic residue will remain. Preferably at least most of the thermolabile surfactant will be decomposed by the drying heat as the web is being dried on drying cylinders of a paper or board machine. The rest would decompose in the hot roll of paper or board as produced. However, additional heating of the web for decomposing the residual surfactant before rolling may be arranged if necessary.

Preferably the hydrophobic size is alkyl ketene dimer (AKD) or a derivate thereof. However, alkenyl succinic anhydride (ASA) or rosin size may be used as an alternative. The amount of hydrophobic size is preferably more than 1 kg/t of dry pulp. The hydrophobicity of the finished web surface by Cobb 60 s water test is preferably less than 30 $g/m^2$.

The surfactant may advantageously be formed from an AKD precursor by activation with a base, an alcohol or water. The product is a labile ionic surfactant, which decomposes yielding a non-hydrophilic ketone by heating. Tests performed with foams show that the foaminess with such AKD-based surfactants decreases progressively with rising temperature, the foam being lost in a few minutes at 95° C. The results indicate that the surfactant would be substantially decomposed as the web runs through the drying section of a paper or board machine.

An alternative approach of suppressing the hydrophilic aspect of the surfactant is turning the surfactant insoluble by heat. An example of such surfactants is linear ethoxylated $C_{11}$-alcohol. Tomadol® available from Air Products and Chemicals Inc. may be cited as a representative commercial product.

The microfibrils of MFC typically have a fibre length of about 100 nm to 10 μm and a fibre diameter of about 3 to 50 nm. The term microfibrillated cellulose (MFC) as used to define the invention also covers nanofibrillated cellulose (NFC).

MFC contained in the foam at least partially provides the fibrous base of the web, and also contributes to stabilisation of the foam by limiting the bubble size growth in the foam. For improved stabilization of the foam, protein, such as casein, or polyvinyl alcohol (PVOH) may advantageously be incorporated therein.

As surfactants, e.g. AKD-based and all soaps, are sensitive to calcium and magnesium present in hard tap water, complexing agents such as EDTA and DTPA may be added for binding Ca and Mg into complexes. At the same time the pH of the foam may be adjusted sufficiently high, e.g. by means of $NaHCC_3$-buffer, to prevent dissolution of $CaCO_3$, or $CO_2$ may be supplied to turn any dissolved $Ca^{++}$ into $CaCO_3$.

For a fibrous web newly formed on a forming fabric MFC is preferably mixed with a different kind of fibrous pulp, usually with the aim of increasing the bulk of the web as formed.

For additional sizing of the web starch may also be incorporated in the foam, preferably in an amount of more than 15 kg/t of dry pulp, more preferably above 20 kg/t of dry pulp. Starch improves retention on the forming fabric and has a synergistic effect with MFC, reducing shrinking of the web and improving the web strength. The ratio of MFC to starch is usually in the range of 1:1 to 2:1.

As an embodiment of the invention a pulp of a high fiber length, mechanical, or chemical, can be incorporated in the foam in combination with MFC. Such a combination lends a substantially increased strength to paper and board products while preserving the low density as sought by the foaming technique.

Usefully the fibrous components incorporated in the foam consist of about 5 to 40 wt-%, preferably 10 to 40 wt-% of MFC and about 60 to 95 wt-%, preferably 60 to 90 wt-% of pulp with longer fibres.

The pulp combined with MFC by definition has a greater fibre length, preferably about 1 mm or more. A particularly suitable pulp for use is chemithermomechanical pulp (CTMP), especially high temperature CTMP. However, other long fibre pulps useful for the purpose are chemical pulps, chemimechanical pulp (CMP), thermomechanical pulp (TMP), GW, and other high yield pulps such as APMP and NSSC.

Without being bound to any theory it is believed that in the combination the long fibres of CTMP or the like provide the bulky structure and the MFC provides the bonding between the long fibres. The method has been found to achieve a bulk of at least 2.5 $cm^3/g$, preferably 3 to 7 $cm^3/g$. The method also proved to work well with CTMP milling reject, showing the possibility to use less refined pulp for the product, e.g. triple-layer packaging board middle layer.

In the foam forming neither individual long fibres nor MFC alone is able to form flocks, but however, MFC is able to build bridges between individual long fibres thus lend surprisingly good strength properties to the web.

As foam forming prevents flock formation between long fibres, very good grammage formation can be gained. This improves the evenness of the print quality as there is less calibre variation in the paper and board.

These stiff long fibres of CTMP are able to maintain the bulky structure in wet pressing and drying thus giving surprisingly good bulk for the sheet.

An interesting result in comparison of water and foam laid samples was that tensile stiffness index was very close in both cases even though the foam formed samples were much bulkier. The reason for that is currently unknown and it needs more research.

According to an embodiment of the invention a continuous fibrous web is formed in an industrial scale on a running forming fabric of a paper or board machine, dewatered by suction through the web and the forming fabric, and finally dried in a drying section of the paper or board machine.

The web may be dewatered by suction of air through the web and the forming fabric at a pressure of at most 0.6 bar, followed by predrying by suction of air at a pressure of at most about 0.3 bar.

According to a still further embodiment of the invention the foam is brought to an air content of 60 to 70 vol-% before being supplied onto the forming fabric. The consistency of the pulp subjected to foaming may be in the range of 1 to 2 % based on the amount of water. Suitable amount of surfactant in the foam may be in the range of 0.05 to 2.5 wt-%, but will be easily determinable by a skilled person. As noted above, use of hard water necessitates larger amounts of surfactant or use of complexing agents to bind Ca and Mg.

Foam forming by use of long cellulosic fibres and added microfibrillated cellulose in the foam may be used for producing all paper and board grades needing best possible formation combination with best possible bending stiffness.

Such products include for example all paperboard grades such as

- cartonboards, white line chipboard, solid bleached board, solid un bleached board, liquid packaging board etc.,
- container boards, including linerboard, corrugated medium etc.,
- special boards, including core board, wall paper base, book binding board, woodpulp board, etc.

The products also include for example paper grades such as newsprint, improved news print, rotonews, MFC, LWC, WFC, art and ULWC.

The high bulk high strength structure can also be used for example:

- as middle ply in multiply structures (papers and boards),
- in lamination to other paper structures and/or plastic film layers,
- as fibrous base for extrusion coating with plastics,
- as heat insulation, noise insulation, liquid and moisture absorber,
- as formable layer in moulded structures such as trays, cups, containers.

The hydrophobically sized fibrous web according to the invention, which is obtainable by the method as described in the above, comprises a mixture of microfibrillated cellulose (MFC) and a pulp of a greater fibre length, together with a hydrophobic size, and has a bulk of at least 2.5 $cm^3/g$, preferably a bulk of 3 to 7 $cm^3/g$.

The fibrous web according to the invention preferably has a Scott bond value in the range of 120 to 200 $J/m^2$.

The pulp of a greater fibre length in the fibrous web according to the invention may be mechanical pulp, preferably CTMP. In general the fibrous web comprises about 5 to 40 wt-% of MFC and about 60 to 95 wt-% of pulp of a greater fibre length.

A further sizing component, such as starch, may be comprised in the web.

As the fibrous web according to the invention is used as a single layer in a multilayer paperboard or cardboard, it may be positioned as a middle layer, while the outer surface layers may be fibrous webs of a lower bulk than said middle layer. For instance denser print plies with a high elastic modulus, made by standard papermaking techniques, may constitute such outer layers. The multilayer products obtainable by use of the invention include liquid packaging boards and cupboards for instance. However, it is possible to produce all the layers of a multilayer board by the foam forming technique according to the invention. Thus a bulkier middle layer of MFC and CTMP and thinner outer layers of MFC and kraft pulp, or coating layers of MFC only, may each be foam formed and hydrophobically sized to prevent raw edge penetration (REP) of liquids into the multilayer board material.

In addition to web forming on a forming fabric of a paper or board machine the invention is also applicable to providing a fibrous coating layer onto a previously formed fibrous web base. In this case the method according to the invention comprises the steps of (i) bringing water, microfibrillated cellulose (MFC), hydrophobic size, and a heat-sensitive surfactant into a foam, (ii) supplying the foam as a coat onto said fibrous web, (iii) subjecting the coat to drying, and (iv) heating the coat to suppress the hydrophilic functionality of the surfactant.

In the coating applications according to the invention MFC alone preferably forms the fibrous constituent of the foam. Otherwise the various embodiments and parameters discussed above and/or claimed in connection with forming a web on a forming fabric are also applicable in said coating applications. An exception, however, is the air content of the foam, which may be up to 80 vol-% in the coating applications. If desired, pigments, PVOH, carboxy methyl cellulose and other usual surface sizing and mineral coating components may be incorporated in the foam. Most of the heat-sensitive surfactant will be decomposed in infrared drying of the coated web, any residues in the paper or board web roll as produced.

A still further aspect of the invention is use of a heat-sensitive surfactant for forming a hydrophobically sized layer of a fibrous web. Such use comprises bringing water, cellulosic fibres, hydrophobic size and said heat-sensitive surfactant into a foam, supplying the foam as a layer onto a substrate, subjecting the layer to drying, and heating the layer to suppress the hydrophilic functionality of the surfactant. Previously heat-sensitive surfactants have not been used or suggested for use in paper web forming or coating by foam techniques. As applied for hydrophobically sized webs and coatings the invention solves the problem of the present surfactants gradually destroying the hydrophobic sizing. The invention as well as its benefits do not depend on the type of the cellulosic fibres, but use of MFC alone for foam coating and a mixture of MFC and longer fibres for foam-based web forming are particularly preferred.

Example

The set-up was as follows:

AKD (Precis 900 liquid AKD by Ashland) was used as surfactant precursor. The AKD was activated in KOH/ethanol/water solution using a 100 minute protocol. The protocol will give 0.15% ethanol and 1.5 % ethanol in the pulp below, as a byproduct, and the pulp will be somewhat alkaline for the remaining KOH. The pH will be adjusted to 8 with diluted HCl before foaming.

A pulp of 2% dry solids consistency was prepared by diluting with tap water from 16% bleached birch pulp. Tap water was used to simulate reality and account for calcium-soap precipitation from Ca/Mg ions in water of a hardness ca. 3-4 German degrees.

0.01 g activated ADK-surfactant was added in an amount of 0.01 g per 100 ml of diluted pulp and 0.1 g per 100 ml of diluted pulp.

200 ml of the mixtures of pulp and surfactant as obtained were foamed by 1 minute full speed mixing in a food-type mixer and transferred directly to a 1000 ml measurement cylinder. Foaming was monitored at t=0, t=1 min, t=5 min and t=10 min, by measurement of foam volume, drained liquid volume and foam expansion number (total volume of foam in cylinder/200 ml of unfoamed mixture).

Results 0.2 % of surfactant (half of it consumed due to hardness in water, but that can be fixed either by complexing agents or by the fact that the process liquid is already saturated with AKD-calcium soap, if AKD-sizing is applied), 200 ml pulp (2%) initially, which turns into 170 ml foamed pulp, containing 70 ml air and 100 ml drained water.

The foamed pulp was very stable over time, no breaking was detected in 10 minutes. The air content was 70/170 or 41%. The bubble size was gauged as satisfactory.

The result indicates that the AKD-based surfactant does form foam in contact with pulp.

The invention claimed is:

1. A method for the preparation of a hydrophobically sized layer of a fibrous web, the method comprising the steps of:

forming a foam comprising water, microfibrillated cellulose (MFC), hydrophobic size, and a heat-sensitive surfactant incorporated in the foam;

supplying the foam onto a forming fabric;

dewatering the foam on the forming fabric by suction to form a web;

subjecting the web to drying; and heating the web to suppress the hydrophilic functionality of the surfactant.

2. The method of claim 1, wherein the hydrophobic size is alkyl ketene dimer (AKD) or a derivate thereof.

3. The method of claim 1, wherein the surfactant is decomposed by heat, removing the hydrophilic moiety from a hydrophobic residue.

4. The method of claim 3, wherein the surfactant is formed from an AKD precursor by activation with a base, an alcohol or water.

5. The method of claim 1, wherein the surfactant is turned insoluble by heat.

6. The method of claim 5, wherein the surfactant is linear ethoxylated $C_{11}$-alcohol.

7. The method of claim 1, wherein protein is incorporated in the foam for stabilizing the same.

8. The method of claim 7, wherein the protein is casein.

9. The method of claim 1, wherein starch is incorporated in the foam for additional sizing of the web.

10. The method of claim 1, further comprising a pulp of a greater fibre length incorporated in the foam, wherein the MFC has a fibre length of about 10 μm or less, and wherein the pulp of a greater fibre length has a fibre length of about 1 mm or more.

11. The method of claim 10, wherein said pulp of a greater fibre length is mechanical pulp.

12. The method of claim 11, wherein said pulp of a greater fibre length is chemithermomechanical pulp (CTMP).

13. The method of claim 10, wherein the fibrous components incorporated in the foam consist of about 5 to 40 wt-% of MFC and about 60 to 95 wt- % of the pulp of a greater fibre length.

14. The method of claim 10, wherein said pulp of a greater fibre length is chemithermomechanical pulp (CTMP).

15. The method of claim 1, wherein a continuous fibrous web is formed on a running forming fabric of a paper or board machine, dewatered by suction through the web and the forming fabric, and finally dried in a drying section of the paper or board machine.

16. A method for providing a hydrophobically sized coating layer on a fibrous web, the method comprising the steps of:

forming a foam comprising water, microfibrillated cellulose (MFC), hydrophobic size, and a heat-sensitive surfactant incorporated in the foam;

supplying the foam as a coat onto said fibrous web;

subjecting the coat to drying; and heating the coat to suppress the hydrophilic functionality of the surfactant.

17. Use of a heat-sensitive surfactant for forming a hydrophobically sized layer of a fibrous web, by forming a foam comprising water, cellulosic fibres, hydrophobic size and said heat-sensitive surfactant incorporated in the foam, supplying the foam as a layer onto a substrate, subjecting the layer to drying, and heating the layer to suppress the hydrophilic functionality of the surfactant.

18. The use of claim 17, wherein the cellulosic fibres comprise microfibrillated cellulose (MFC).

19. The use of claim 18, wherein the foam is supplied as a coating layer to a fibrous web, which forms the substrate.

20. The use of claim 18, wherein the cellulosic fibres comprise MFC mixed with pulp of a greater fibre length, the MFC has a fibre length of about 10 μm or less, the pulp of a greater fibre length has a fibre length of about 1 mm or more, and the foam is supplied as a layer onto a forming fabric serving as the substrate, to be dewatered by suction and formed to a fibrous web.

* * * * *